US010267474B2

(12) United States Patent
King

(10) Patent No.: US 10,267,474 B2
(45) Date of Patent: Apr. 23, 2019

(54) VEHICLE LIGHTING AND/OR SIGNALING DEVICE HAVING A STEERABLE DYNAMIC BEAM

(71) Applicant: Valeo North America, Inc., Seymour, IN (US)

(72) Inventor: Robert Lee King, Seymour, IN (US)

(73) Assignee: Valeo North America, Inc., Seymour, IN (US)

( * ) Notice: Subject to any disclaimer, the term of this patent is extended or adjusted under 35 U.S.C. 154(b) by 43 days.

(21) Appl. No.: 15/203,105

(22) Filed: Jul. 6, 2016

(65) Prior Publication Data

US 2018/0009366 A1 Jan. 11, 2018

(51) Int. Cl.

| | |
|---|---|
| ***F21V 17/02*** | (2006.01) |
| ***F21S 41/19*** | (2018.01) |
| ***H05B 33/08*** | (2006.01) |
| ***F21S 41/20*** | (2018.01) |
| ***F21S 45/43*** | (2018.01) |
| ***F21S 41/39*** | (2018.01) |
| ***F21S 41/141*** | (2018.01) |
| ***F21S 41/147*** | (2018.01) |
| ***F21S 41/33*** | (2018.01) |
| ***F21S 41/663*** | (2018.01) |
| ***F21S 41/675*** | (2018.01) |
| ***F21S 43/13*** | (2018.01) |
| ***F21S 43/14*** | (2018.01) |
| ***F21S 43/37*** | (2018.01) |
| ***F21S 43/31*** | (2018.01) |
| ***F21S 41/16*** | (2018.01) |
| ***F21S 41/151*** | (2018.01) |
| *F21S 45/47* | (2018.01) |
| *F21W 102/13* | (2018.01) |

(52) U.S. Cl.

CPC ..... *F21S 41/19* (2018.01); *F21S 41/141* (2018.01); *F21S 41/147* (2018.01); *F21S 41/151* (2018.01); *F21S 41/16* (2018.01); *F21S 41/285* (2018.01); *F21S 41/336* (2018.01); *F21S 41/39* (2018.01); *F21S 41/663* (2018.01); *F21S 41/675* (2018.01); *F21S 43/13* (2018.01); *F21S 43/14* (2018.01); *F21S 43/31* (2018.01); *F21S 43/37* (2018.01); *F21S 45/43* (2018.01); *H05B 33/0845* (2013.01); *F21S 45/47* (2018.01); *F21W 2102/13* (2018.01)

(58) Field of Classification Search

CPC ..... B06Q 1/06; B06Q 1/068; B06Q 1/076; B06Q 1/11; B06Q 1/115

USPC ..... 362/507, 512, 515, 531, 532

See application file for complete search history.

(56) References Cited

U.S. PATENT DOCUMENTS

| | | | | |
|---|---|---|---|---|
| 5,335,157 A * | 8/1994 | Lyons | ..... | B60Q 1/2611 362/297 |
| 6,352,357 B1 | 3/2002 | Woolard | | |
| 8,721,146 B2 * | 5/2014 | Kathmann | ..... | F21S 48/1109 362/469 |

(Continued)

*Primary Examiner* — Daniel St Cyr

(74) *Attorney, Agent, or Firm* — Oblon, McClelland, Maier & Neustadt, L.L.P.

(57) ABSTRACT

A steerable lighting and/or optical device for a vehicle. A light source transmits a light beam to a rotating mirror which scans or points the light transversely ahead of the vehicle to create a desired beam shape. An intensity of the light source may be modulated during sweeping, including modulation to zero intensity, to control the pattern of light generated by the sweeping beam.

20 Claims, 15 Drawing Sheets

(56) References Cited

U.S. PATENT DOCUMENTS

| | | | | |
|---|---|---|---|---|
| 8,851,722 | B2 * | 10/2014 | Fedosik | F21S 48/125<br>362/507 |
| 8,920,056 | B2 * | 12/2014 | Matsumura | H05K 5/03<br>400/691 |
| 9,333,904 | B2 | 5/2016 | Dross | |
| 2014/0003070 | A1 * | 1/2014 | Nakaya | B60Q 1/08<br>362/466 |
| 2015/0022085 | A1 | 1/2015 | Dross | |

* cited by examiner

VEHICLE LIGHTING AND/OR SIGNALING DEVICE HAVING A STEERABLE DYNAMIC BEAM

BACKGROUND OF THE INVENTION

1. Field of the Invention

This invention relates to a vehicle lighting and/or signaling device having a steerable dynamic beam.

2. Description of the Related Art

In the field of automotive lighting, it is desirable and even mandatory to provide, for example, headlamp assemblies with the capability of producing various beam patterns, such as low beam patterns and high beam patterns and the like. The headlamp assemblies have become considerably complex and expensive.

As the performance of solid-state light sources, such as light-emitting diodes (LEDs), is rapidly improving, new applications for solid-state light sources are emerging. For automotive headlamps, it would be desirable to be able to control and change the illumination pattern electronically depending on the driving conditions or the desired beam pattern selected by a driver.

What is needed, therefore, is a headlamp device that is capable of painting or generating various beam patterns, but yet is simple in manufacturing costs compared to complex and expensive components, such as DLP modules or galvometers.

SUMMARY OF THE INVENTION

One object of one embodiment of the invention is to provide a radial spinning beam/slicing dynamic lamp assembly, such as a headlamp assembly.

Another object of one embodiment of the invention is to provide a system and method that generates a beam slicing dynamic beam using a rotating optical system.

Still another object of one embodiment of the invention is to provide a lamp assembly that utilizes a rotating optical system that utilizes a rotating drum having a plurality of reflective facets.

Still another object of one embodiment of the invention is to provide a lamp assembly that utilizes a rotating optical system that utilizes a rotating drum that is transparent and has a plurality of transparent facets.

Still another object of one embodiment of the invention is to provide a simplified dynamic beam module that contains a few simple components, such as a light source, a primary optical lens or reflector that gathers light to provide a vertical cut off and a narrow intense beam and a multiple beam shaping optical rod or drum that allows multiple beam patterns of light to be created.

In one embodiment, a housing contains a light source, such as a solid state light source, a light emitting diode LED (e.g., one chip or multichip), highly pixellized LED, or a laser diode. The light source is mounted on a printed circuit board (not shown) that is mounted on a heat sink that is part of the housing. Although a single light source is shown, it should be understood that the light source may comprise a plurality of light sources. The light source produces light beam which can take the form of a bundle or fan of light rays as explained later herein.

In one aspect, one embodiment of the invention comprises a steerable lighting and/or optical device for a vehicle, comprising at least one light source which produces a fan of light definable into sectors, a control system configured to determine light intensity for each sector and to energize at least one determined pattern of light projected ahead of the vehicle In another aspect, another embodiment of the invention comprises a steerable lighting and/or optical device for a vehicle, comprising at least one light source which projects at least one light ray, a rotating body having reflective facets along its periphery, each of which passes through the at least one light ray during rotation and reflects the at least one light ray to generate a beam pattern.

In still another aspect, another embodiment of the invention comprises a steerable lighting and/or optical device for a vehicle, comprising at least one light source which projects light rays, a rotating reflector having multiple reflective facets which sweep in sequence through the light rays to generate a beam of reflected rays, a control system which modulates intensity of the at least one light source to thereby control light intensity in sectors of the fan of light.

In yet another aspect, another embodiment of the invention comprises a steerable lighting and/or optical device for a vehicle, comprising a rotating drum having reflective facets on its periphery which sweep past a reference point, at least one light source which projects light toward the reference point, which the sweeping facets reflect into a fan of light which is projected from the vehicle, a control system which senses rotational position of the rotating drum and modulates the at least one light source according to a mode of operation which mode is selected by a human driver from a group of possible modes of operation, and which selected mode produces a selected pattern or beam of light.

In another aspect, another embodiment of the invention comprises a steerable lighting and/or optical device for a vehicle, comprising an incident light beam, a moving mirror which receives the incident light beam at progressively increasing angles of incidence, and reflects the incident light beam at progressively increasing angles of reflectance, to generate a fan of reflected light, a control system which modulates intensity of the incident light beam at selected angles of incidence.

In another aspect, another embodiment of the invention comprises a process for generating a beam for a motor vehicle, said process comprising the steps of rotating a drum having a plurality of reflecting facets on its periphery, energizing at least one light source to emit light towards said rotating drum, and controlling an intensity of light emitted by said at least one light source so that said light emitted by said at least one light source is reflected by at least one of said plurality of reflective facets to produce a fan of light that collectively provide the beam.

In another aspect, another embodiment of the invention comprises a lighting device comprising a housing, at least one steerable lighting and/or optical device for a vehicle, comprising an incident light beam, a moving mirror which receives the incident light beam at progressively increasing angles of incidence, and reflects the incident light beam at progressively increasing angles of reflectance, to generate a fan of reflected light and a control system which modulates intensity of the incident light beam at selected angles of incidence.

This invention, including all embodiments shown and described herein, could be used alone or together and/or in combination with one or more of the following list of features:

The steerable lighting and/or optical device in which the at least one light source can selectively direct sectors upward and downward.

The steerable lighting and/or optical system in which the steerable lighting and/or optical device comprises a rotating drum positioned to receive light from the at least one light source and provide the fan of light in response thereto.

The steerable lighting and/or optical device wherein the rotating drum comprises a plurality of timing marks on a surface thereof.

The steerable lighting and/or optical device wherein the rotating drum comprises a plurality of reflective facets on its periphery.

The steerable lighting and/or optical device wherein at least one of the plurality of reflective facets comprises an angled face.

The steerable lighting and/or optical device wherein the control system comprises a microprocessor for controlling the at least one light source as it simultaneously controls rotation of the rotating drum.

The steerable lighting and/or optical device wherein the rotating drum is generally transparent.

The steerable lighting and/or optical device wherein the at least one light source comprises a light-emitting diode or laser which emits light toward the rotating drum for reflection.

The steerable lighting and/or optical device and further comprising sensors for ascertaining angular position of the rotating drum and a microprocessor configured to control intensity of the light source based on an angular position.

The steerable lighting and/or optical device wherein the sensors comprise marks on the rotating drum.

The steerable lighting and/or optical device wherein the control system controls intensity from zero to full intensity.

The steerable lighting and/or optical device in which the control system causes some sectors to have at least one of a lower intensity or no intensity.

The steerable lighting and/or optical device in which the control system suppresses the beam of reflected rays which would otherwise occur at the beginning of a sweep.

The steerable lighting and/or optical device in which the control system suppresses reflected rays which would otherwise occur at the end of a sweep.

The steerable lighting and/or optical device in which the control system always suppresses some reflected light which would otherwise occur at the beginning of a sweep of a facet.

The steerable lighting and/or optical device in which the control system always suppresses some reflected light which would otherwise occur at the end of a sweep of a facet.

The steerable lighting and/or optical device in which the selected pattern of light is different from at least one other pattern produced by another mode.

The steerable lighting and/or optical device and further comprising a cooling fan which rotates with the rotating drum, which cools the at least one light source.

The steerable lighting and/or optical device and further comprising a selector switch, operable by a driver of the vehicle, to select a predetermined mode of operation.

The steerable lighting and/or optical device in which the selector switch allows the driver to select one of a predetermined modes of operation, but the driver is not able to change a mode of operation.

The steerable lighting and/or optical device which produces a beam which, in at least some regions, is uniform in color and continuous in intensity from top to bottom.

The steerable lighting and/or optical device wherein the steerable lighting and/or optical device comprises a plurality of light sources, the control system selectively energizing the plurality of light sources during rotation of the rotating drum to generate a beam comprising a predetermined matrix pattern of beams from the plurality of light sources The steerable lighting and/or optical device in which the control system terminates the incident light beam at selected angles of incidence.

The steerable lighting and/or optical device in which the moving mirror rotates about an axis.

The steerable lighting and/or optical device which produces a beam which, in at least some regions, is uniform in color and continuous in intensity within the at least some regions.

A lighting device comprising at least one or a plurality of steerable lighting and/or signaling devices according to any of the embodiments of the invention.

While the embodiments have been shown and described as having a use as a headlight for a vehicle, the lighting and/or signaling device could also be placed in a rear lamp, fog lamp, daytime running lamp, marker lamp, interior lighting lamp or the like.

These and other objects and advantages of the invention will be apparent from the following description, the accompanying drawings and the appended claims.

BRIEF DESCRIPTION OF THE ACCOMPANYING DRAWINGS

Figure 1:
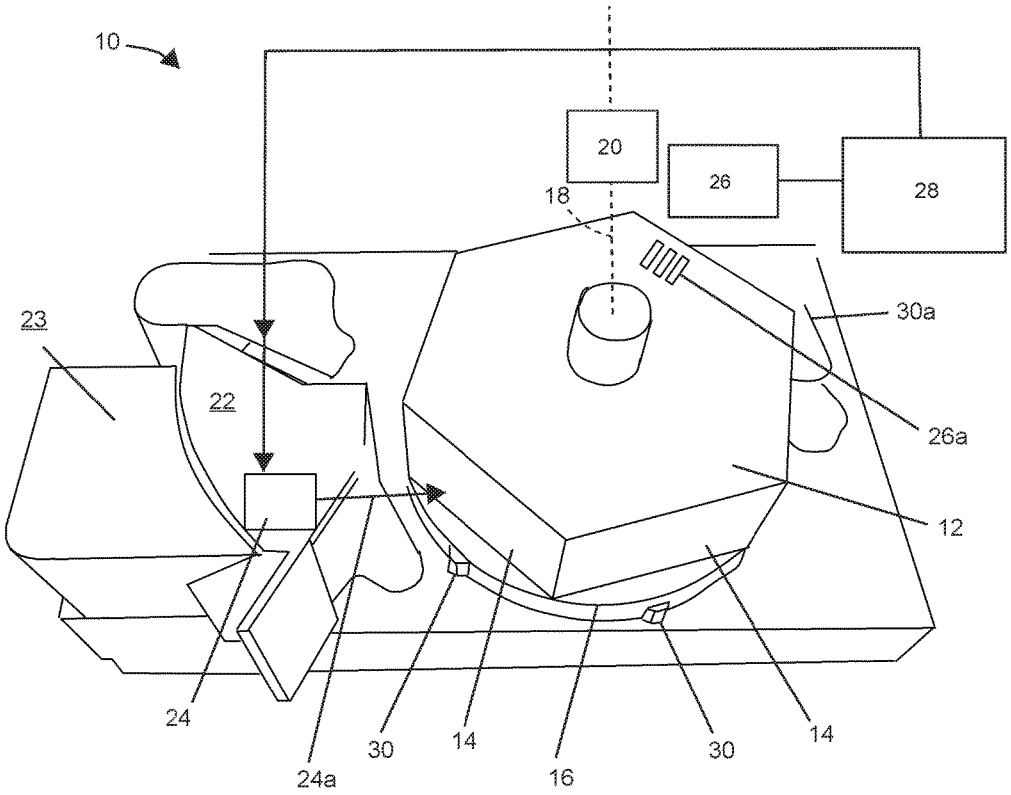
FIG. 1 illustrates one form of the invention.
Figure 4:
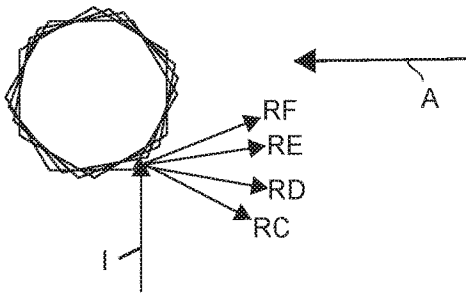
Figure 3:
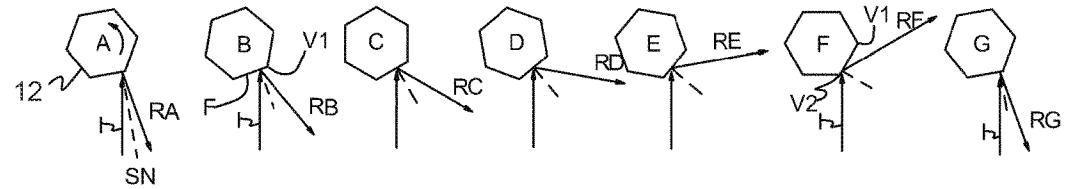
FIG. 3 illustrates a sequence of rotational positions of the drum of FIG. 1, together with the respective reflected rays.
Figure 3A:
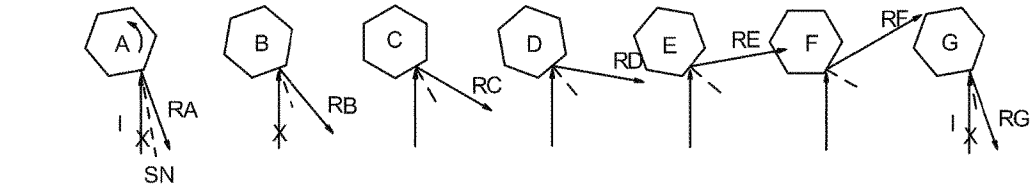
Figure 6:
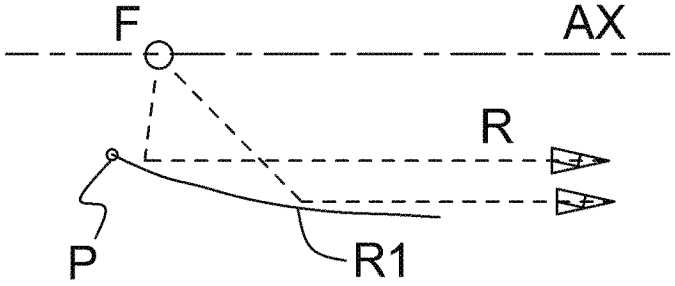
Figure 5:
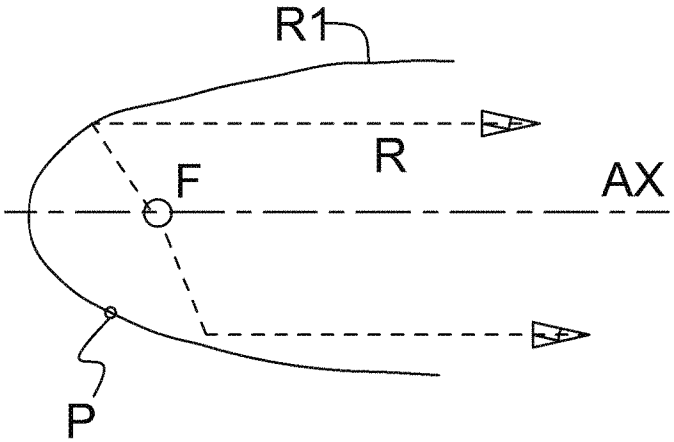
Figure 7:
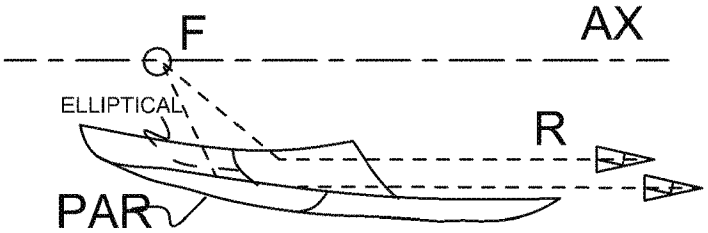
Figure 9:
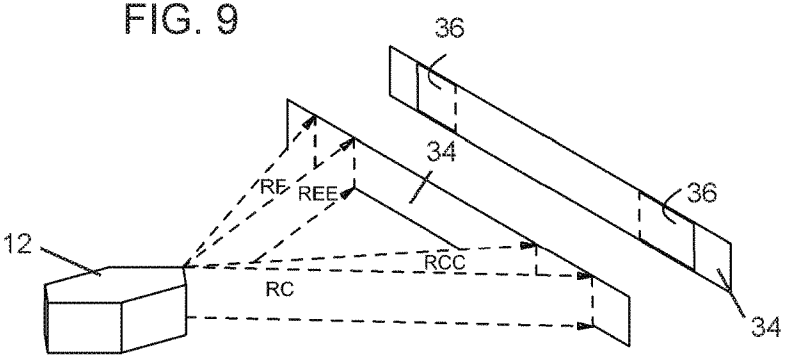
Figure 12:
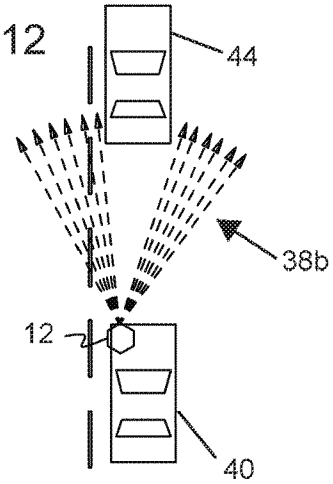
Figure 8:
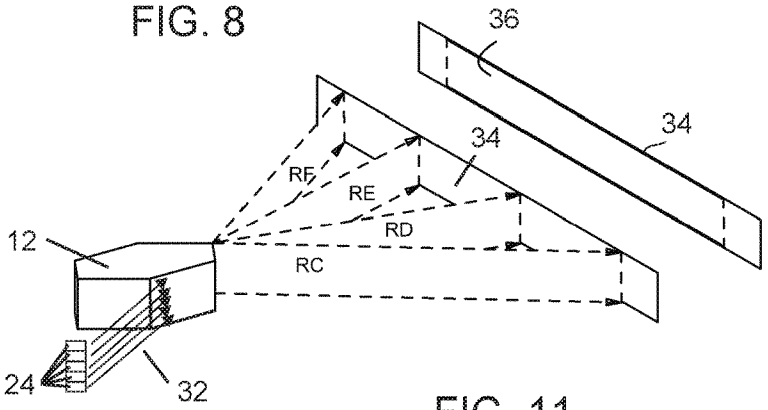
Figure 11:
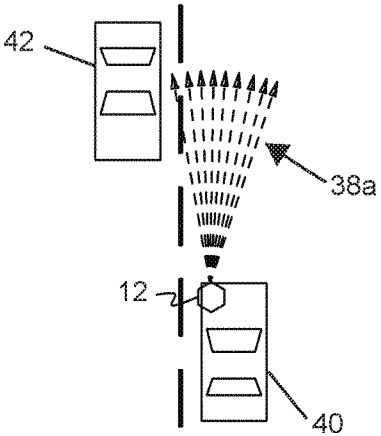
Figure 10:
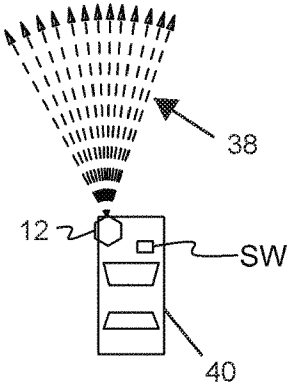
Figure 9A:
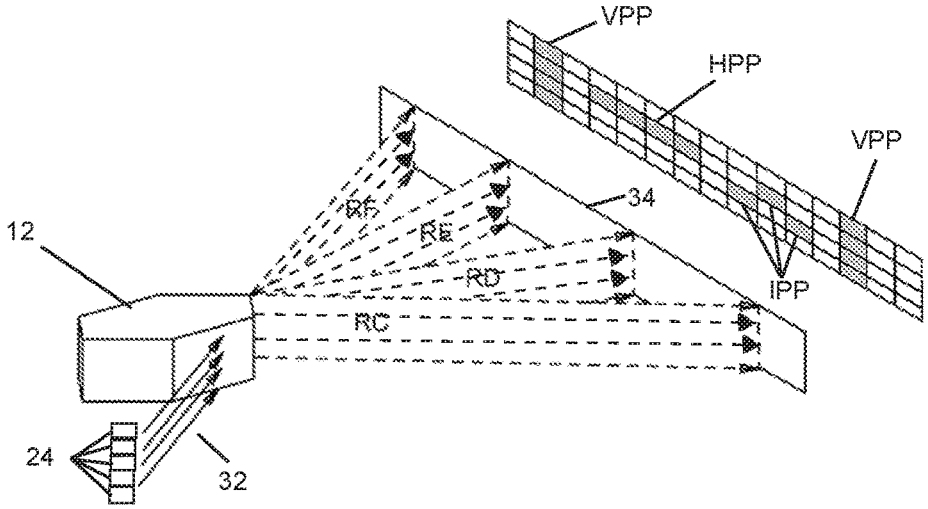
Figure 13:
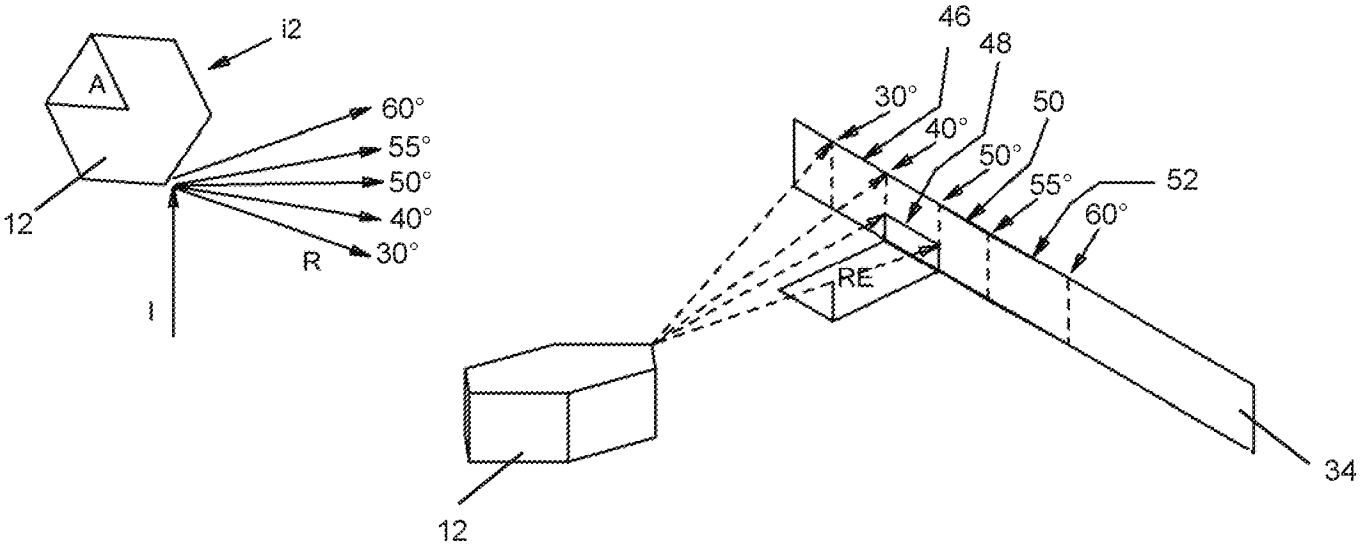
Figure 15:
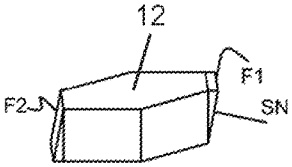
Figure 18:
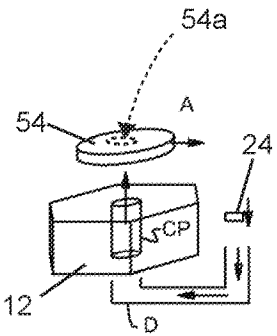
Figure 14A:
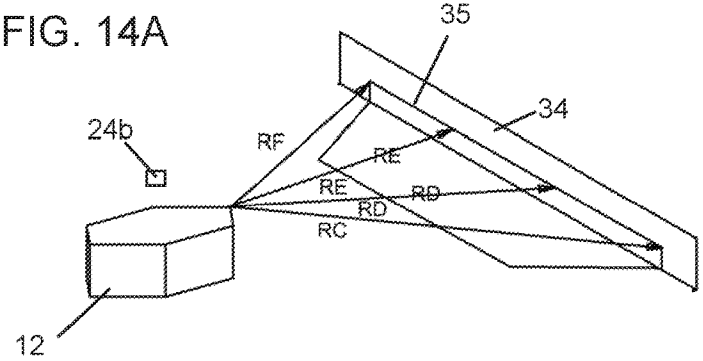
Figure 17:
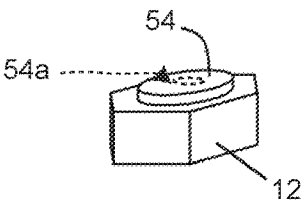
Figure 14:
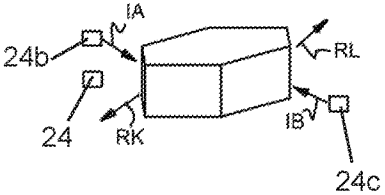
Figure 16:
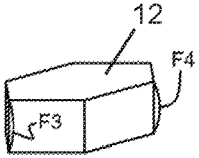
Figure 19:
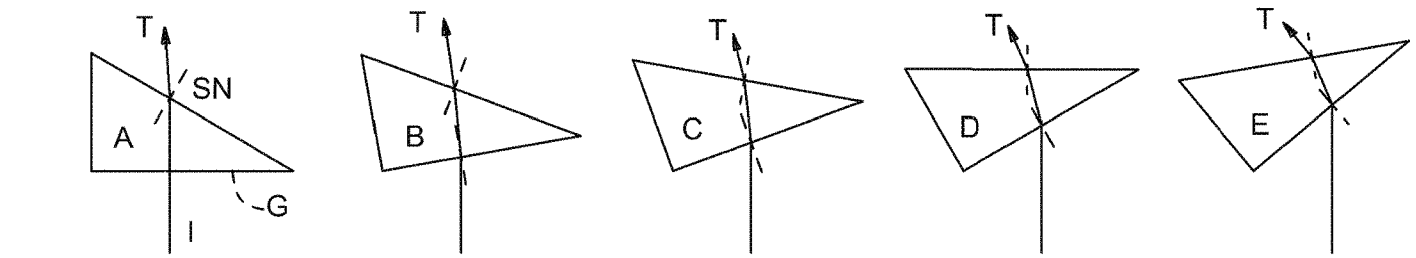
Figure 20:
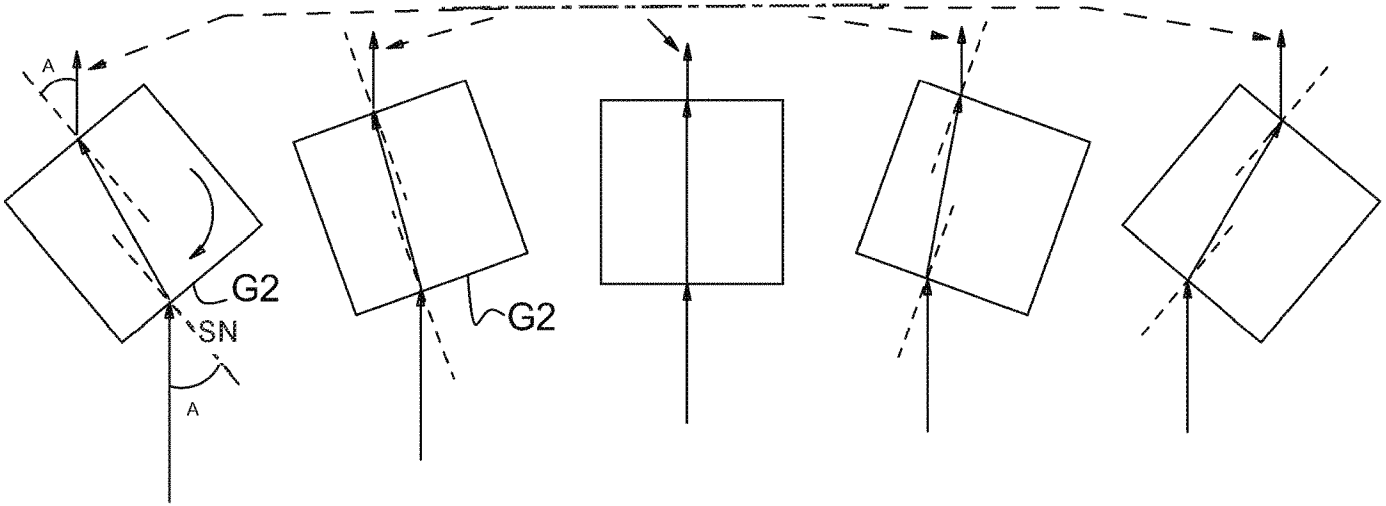
Figure 21:
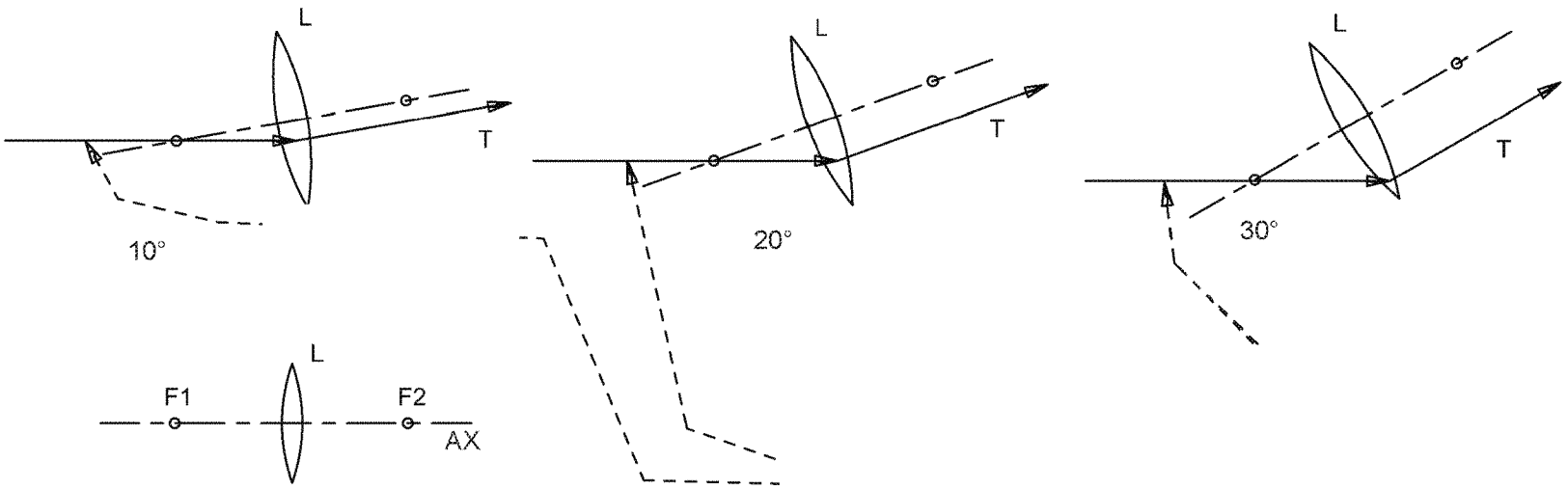
Figure 22:
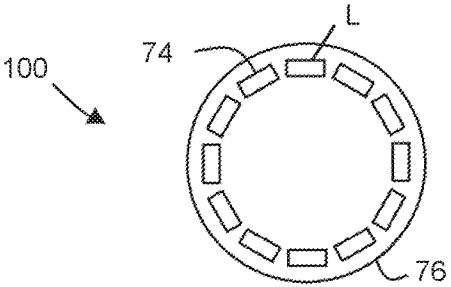
Figure 23:
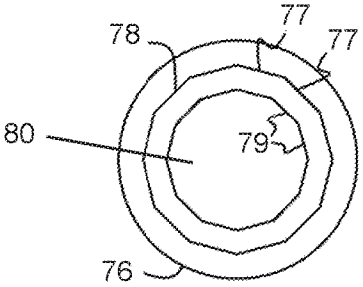
Figure 24:
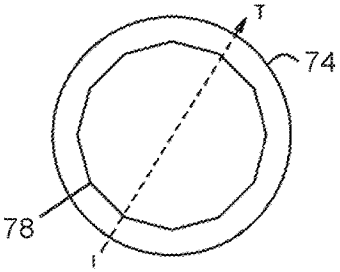
Figure 25:
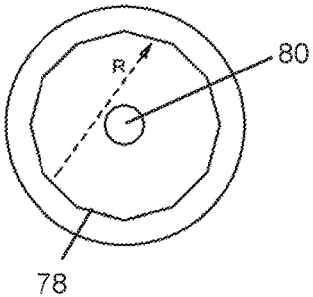
Figure 26:
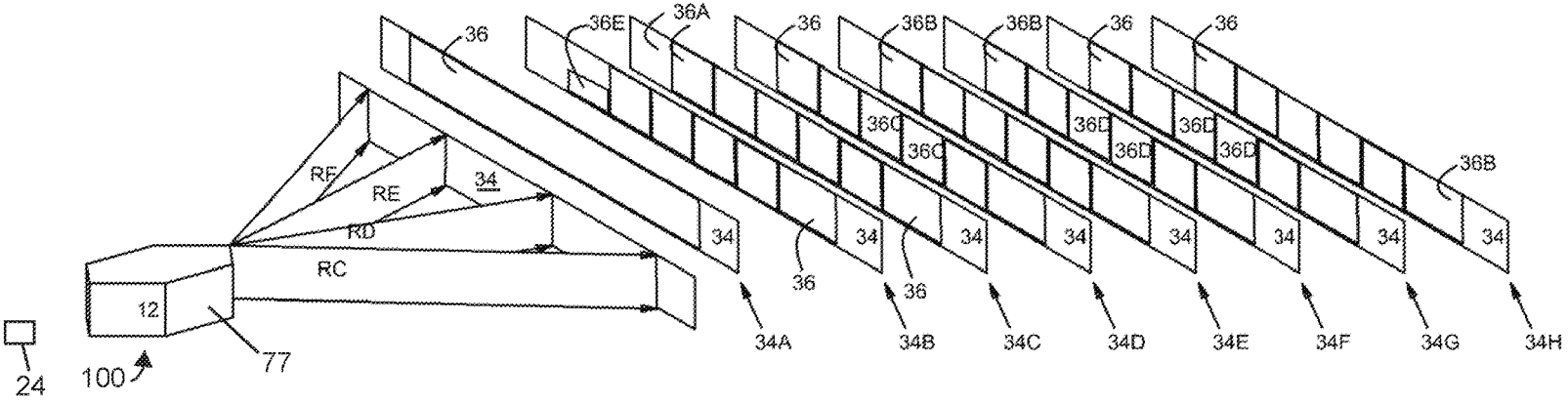
Figure 27:
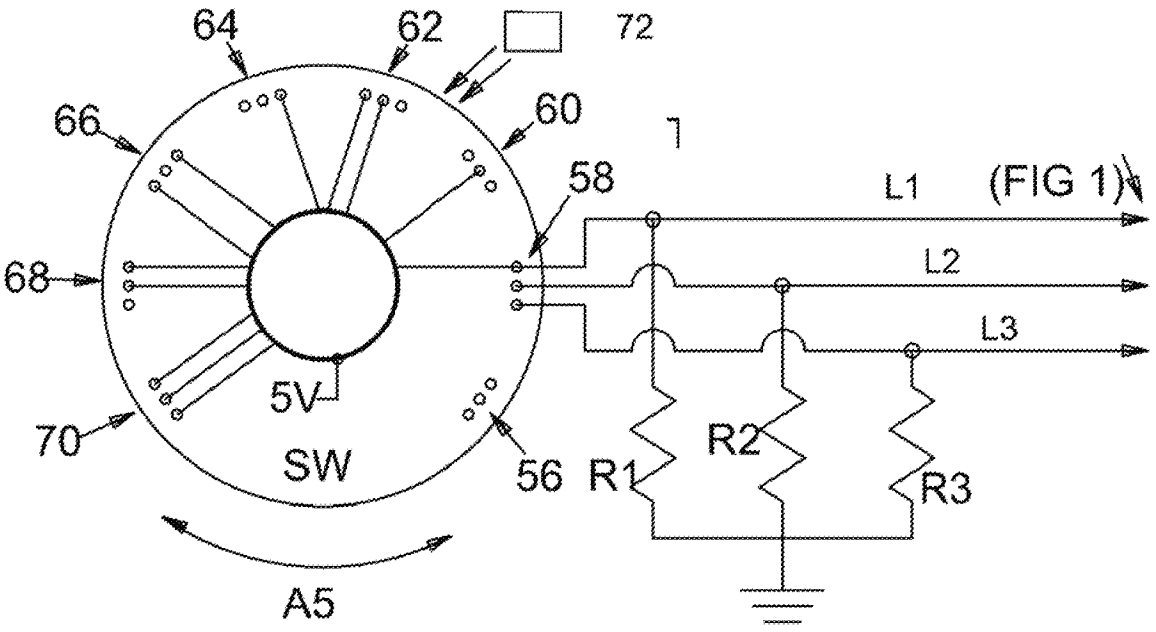
Figure 29:
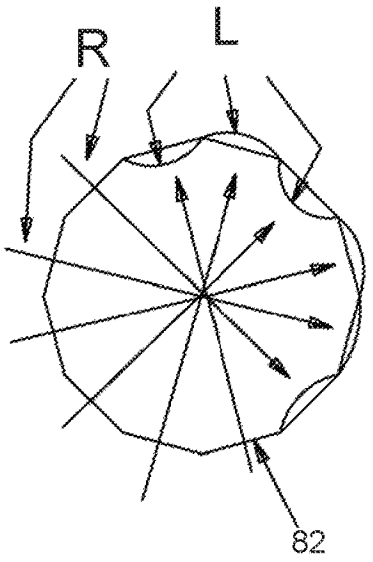
Figure 28:
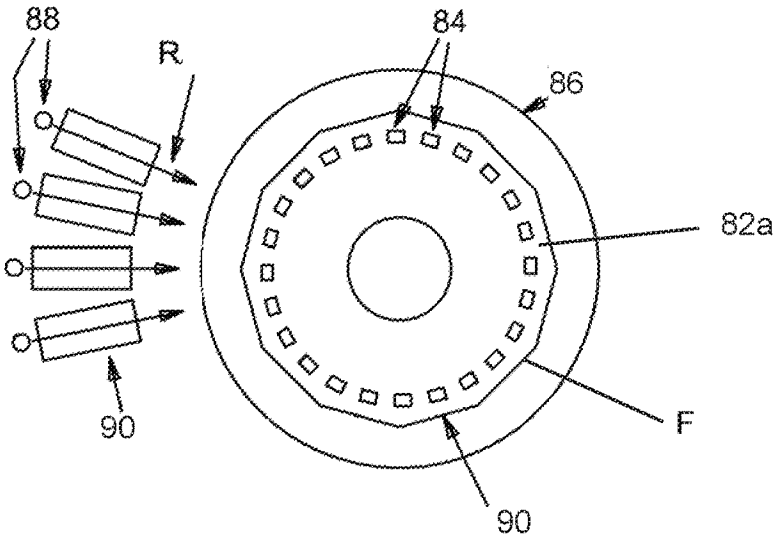
Figure 30:
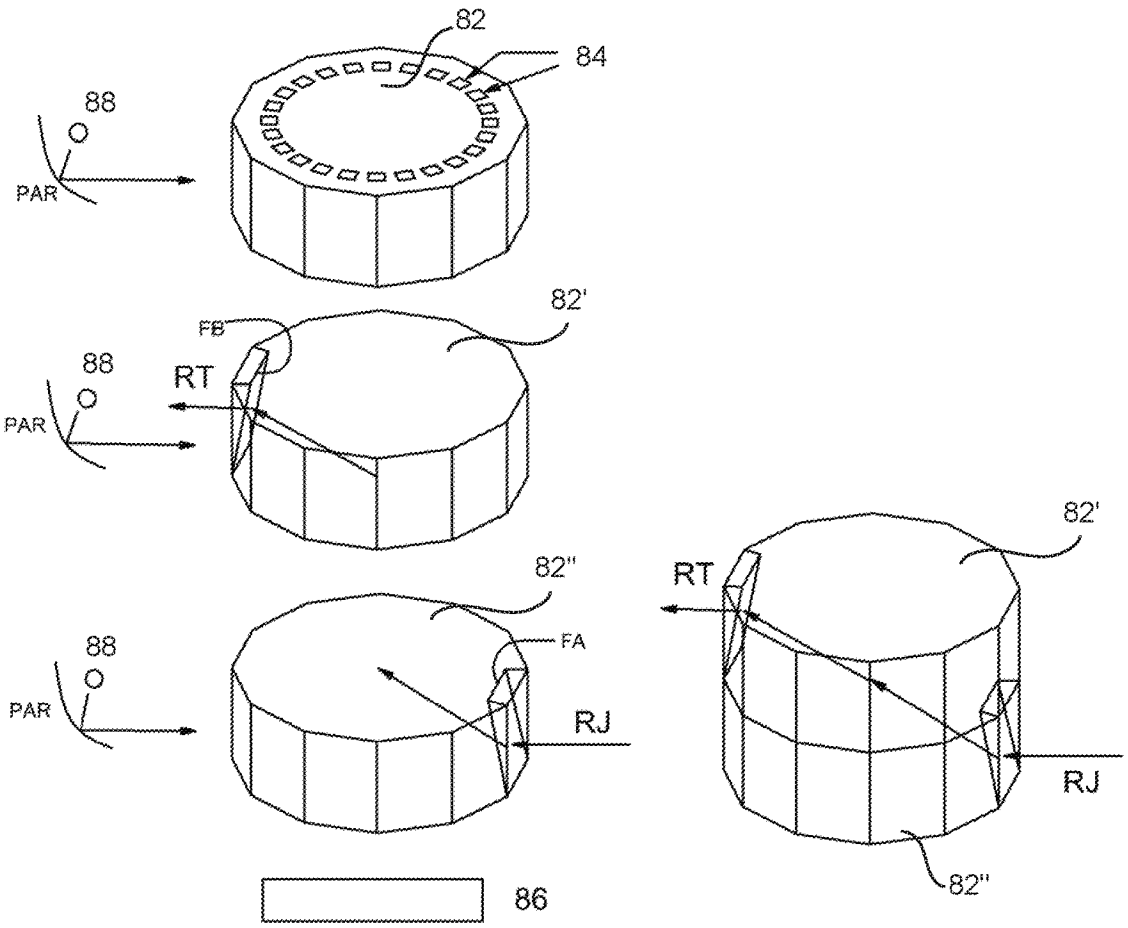
Figure 32:
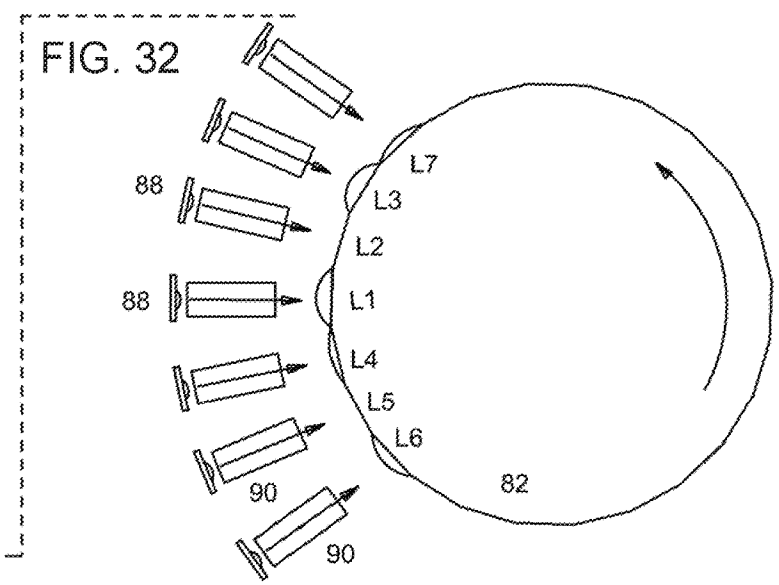
Figure 31:
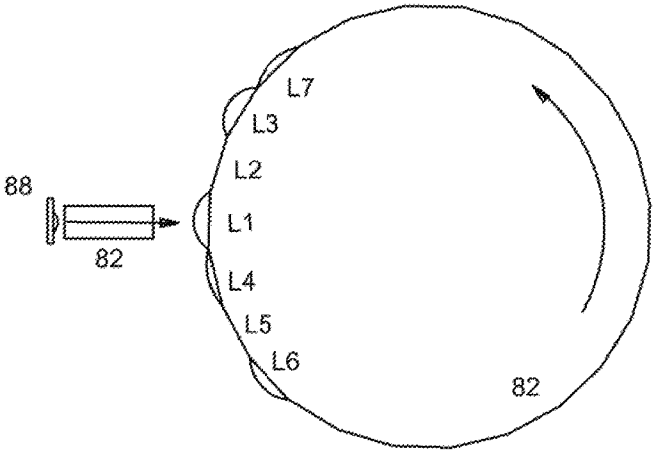

FIG. 3A indicates suppression of the incident light ray, by the three X's;

FIG. 4 is a composite drawing, showing stages C, D, E, and F of FIG. 3 superimposed;

FIG. 5 illustrates a parabolic reflector;

FIG. 6 illustrates the reflector of FIG. 5, but truncated at point P;

FIG. 7 is a perspective vide of the truncated reflector of FIG. 6;

FIG. 8 illustrates a fan of light projected by the apparatus of FIG. 1;

FIG. 9 illustrates two fans of light projected onto a wall, one fan lying between rays RE and REE, and the other fan lying between rays RC and RCC. No light reaches the region between rays RCC and REE;

FIG. 9A illustrates a pixel matrix beam pattern that can be achieved in one embodiment of the invention;

FIGS. 10, 11, and 12 are bird's eye views of a vehicle, which projects different light beams at different times;

FIG. 13 illustrates different regions of illumination of a wall;

FIG. 14 illustrates an incident light ray IA, which enters in a downward direction, to produce a reflected light ray RK traveling downward, to illuminate, for example, the region in FIG. 13. FIG. 14 also illustrates an incident light ray IB, which enters in an upward direction, to produce a reflected light ray RL, traveling upward;

FIG. 14A illustrates a downwardly directed light beam, as produced by downward rays RK in FIG. 14;

FIG. 15 illustrates a downward slanting facet F1 and an upward slanting facet F2 on the drum;

FIG. 16 illustrates a convex facet F4 and a concave facet F3 on the drum;

FIG. 17 illustrates a cooling fan or blower attached to the drum, for cooling a light source;

FIG. 18 illustrates ductwork and flowpaths for cooling air for light source;

FIG. 19 illustrates how a triangular glass lens G can sweep a transmitted light ray T when the lens rotates;

FIG. 20 illustrates how a square glass lens G2 can sweep a transmitted light ray when the lens G2 rotates;

FIG. 21 illustrates how a glass lens L can sweep a transmitted ray when the lens L rotates;

FIG. 22 illustrates an array of twelve optical elements;

FIG. 23 illustrates how the optical elements in FIG. 22 can be coalesced into a ring or torus;

FIG. 24 illustrates how the ring of FIG. 23 can be replaced by a solid body;

FIG. 25 illustrates a type of torus, in which a light ray R does not follow a diameter, but follows a chord;

FIG. 26 illustrates eight different illumination patterns projected by one form of the invention;

FIG. 27 illustrates a rotary switch SW, also indicated in FIG. 10, which allows a driver to select one of the patterns of FIG. 26;

FIG. 28 shows a rotating transparent block, with light sources transmitting light rays R into the block;

FIG. 29 illustrates a modification of the block of FIG. 28, wherein concave and convex lenses L are formed into the block;

FIG. 30 illustrates the block of FIG. 28, together with a single light source;

FIG. 31 illustrates multiple light sources, together with a schedule of which light sources are illuminated under different conditions; and FIG. 32 illustrates how multiple blocks of FIG. 28 can be stacked into a unitary structure.

DETAILED DESCRIPTION OF THE PREFERRED EMBODIMENTS

FIG. 1 illustrates a lighting and/or signaling device 10 for use on a vehicle, such as in a headlamp assembly. The lighting and/or signaling device 10 comprises a polygonal, such as a hexagon, octagon or other polygonal shape, drum 12 of aluminum having polished surfaces or facets 14 which act as mirrors. The drum 12 is carried or supported by a turntable 16 and is rotated about an axis 18 by an electric motor 20. A housing 22 contains a light source 24, such as a light emitting diode LED (e.g., one chip or multichip), highly pixellized LED, or a laser diode. The light source 24 is mounted on a printed circuit board (not shown) that is mounted on a heat sink 23 that is part of the housing 22. Although a single light source 24 is shown, it should be understood that the light source 24 may comprise a plurality of light sources 24. The light source 24 produces light beam 24*a* which can take the form of a bundle or fan of light rays as explained later herein.

It should be understood that the drum 12 may be an integral one-piece construction of a reflective material so that the facets 14 act as mirrors. Alternatively the drum 12 could be made of a material, such as a polymer with the surfaces or facets 14 coated with a reflective coating.

A shaft encoder 26 reads timing marks 26*a*, which extend along the entire circumference of the drum 12, but only three timing marks 26*a* are shown for ease of illustration. Based on the timing marks 26*a*, the shaft encoder 26 produces signals which indicate a rotational position of the drum 12, which are fed to a microprocessor 28. The microprocessor 28 controls the timing of illumination of the light source 24 as explained below.

In the more general case, the shaft encoder 26 in FIG. 1 detects the angular position of the drum 12. The shaft encoder 26 feeds the angular position to the microprocessor 28, which controls the light source 24 by way of an electrical connection, such as wires (not shown).

The turntable 16 contains several cam surfaces 30. These cam surfaces 30 interact with a switch 30*a*, which resembles automotive ignition points used in a distributor of an automobile, such as a vehicle of the 1950's. When a cam surface 30 slides past the switch 30*a*, it momentarily opens a switch, thus momentarily extinguishing the light source 24. Consequently, no light will be reflected by the facets 14 for that momentary period, thus producing a dark sector in the beam of light produced.

Figure 2:
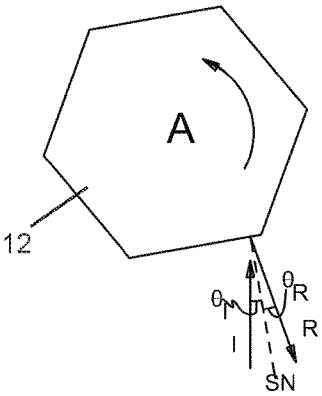
FIG. 2 illustrates the drum of FIG. 1, together with incident light ray and reflected light ray R.

FIG. 2 illustrates an incident light ray I to the drum 12 and a reflected ray R. Under Snell's Law of Reflection, the incident angle θ-I equals the reflected angle θ-R, both measured with respect to the surface normal SN. In FIGS. 2 and 3, the drum 12 rotates, but the incident light I does not move, and is stationary because the light source 24 producing it is also stationary.

FIG. 3 illustrates a sequence of rotational positions taken by the drum 12, and the changing directions of the reflected rays R. As the drum 12 passes through positions A, B, C, D, E, and F, the constant incident ray I is reflected as reflected rays RA, RB, RC, RD, RE and RF. The reflected rays RA, RB, RC, RD, RE and RF sweep upward (as viewed in FIG. 3) as the drum 12 rotates, because the angle of incidence, θ-I in FIG. 2, progressively increases during rotation, thereby requiring the angle of reflection, θ-R, to similarly increase. At position G, the drum 12 returns to its initial position, identical to position A, and the process repeats for the next surface or facet 14.

FIG. 4 is a composite of positions C, D, E, and F, and shows the upward sweep of reflected rays RC, RD, RE, RF. Note that the term "upward" is with reference to the bottom of the drawing. FIGS. 2-4 are plan views of a vehicle headlight beam, so the sweep of FIG. 4 is actually from right to left (as viewed in the direction of arrow A in FIG. 4), or east to west, for a vehicle traveling north.

Although FIG. 2 tacitly presumes that the incident beam I is a pencil-type beam, it should be understood that in one form of the invention, the beam I can take the form of a fan or flat beam. FIGS. 5, 6, and 7 indicate how such a fan or flat beam can be generated. FIG. 5 shows a parabolic reflector R1 having a focus F. It is well known that light originating at the focus F will be reflected as parallel rays R, parallel to the axis AX.

If the reflector R1 is truncated at point P, as in FIG. 6, rays originating at the focus F are still reflected in parallel. FIGS. 5 and 6 illustrate parabolic reflectors, which are two-dimensional geometric structures. A three-dimensional reflector is shown in FIG. 7 and takes the form of a paraboloid PAR. The paraboloid PAR receives light from the focus F and then reflects the light parallel to the axis AX as indicated. The reflector PAR of FIG. 7 is called an off-axis paraboloid.

Therefore, an incoming fan of light rays 32 can be delivered to the drum 12, as in FIG. 8 and be reflected by the rotating drum 12 as indicated, or a pencil beam I can be delivered, as in FIG. 2, and reflected as in FIG. 3. In either case, the reflection pattern generally indicated in FIG. 8 will result and the illumination pattern IP is illustrated for ease of understanding as being projected on a wall 34. In FIG. 8, an illuminated region 36 of the wall 34 is illuminated.

However, if the light source 24 as shown earlier in FIG. 1 is switched on and off at the proper times, the illumination pattern IP of FIG. 9 can be obtained. That is, the light source 24 is switched off in the time interval between the stages labeled D and E (FIG. 3). As shown in FIG. 4, there is no light projected between rays RD and RE. In this case, there would be no illumination in FIG. 9 between rays REE and RCC. Only the spots in the illuminated region 36 are illuminated. Note that FIG. 9 is not drawn to scale with respect to FIGS. 3 and 4.

Advantageously, one embodiment of the invention provides a system and means for generating a steerable light beam or illumination pattern IP, for example, for the headlight of a vehicle 40 (FIG. 10). In some embodiments, the illumination pattern IP may be a solid pattern which may be entirely illuminated or partially illuminated as illustrated in FIG. 9. FIG. 9A illustrates another embodiment wherein the at least one or a plurality of the light sources 24 are selectively energized and adapted to create a pixel matrix beam pattern. Each pixel can be selectively energized by selectively energizing its associated light source 24 during rotation of the drum 12 which causes it to lay a selective illumination pattern IP. In FIG. 9A, the dark pixelated areas illustrate areas that are not illuminated while the light areas shown in FIG. 9A illustrate pixel areas that are illuminated. It should be understood that the non-illuminated or illuminated areas may form a regular pattern such as the vertical pixel pattern VPP or horizontal pixel pattern HPP, but it should be understood that an irregular pattern of pixels may either be or not be illuminated, such as the non-illuminated pixels that create the irregular pixel pattern IPP. It should also be understood that the non-illuminated pixels or illuminated pixels do not necessarily have to be adjacent each other. The important feature is that the plurality of individual pixels created by the light sources 24 and the rotating drum 12 may be selectively energized to create a pixelated matrix pattern of any desired beam pattern.

As is apparent from the illustrations and drawings, the invention thus provides a steerable light beam or illumination pattern IP for the headlight of a vehicle 40 (FIG. 10). FIG. 10 shows the drum 12 projecting an outgoing fan of light rays 38 representing all the rays RC, RD, RE, and RF of FIG. 4. However, in FIG. 11, an oncoming vehicle 42 is present, so a reduced fan 38*a* is projected, representing only rays RC, RD, and RE, but not RF. In FIG. 12, a vehicle 40 follows another vehicle 44. Another reduced fan 38*b* is projected, representing light similar to that of FIG. 9, wherein the central region is dark.

As discussed above, FIG. 4 shows a fan of reflected rays RC, RD, RE, RF generated by the rotating drum 12. An image i2 in the upper part of FIG. 13 represents FIG. 4, but with labels of angles (30°-60°) superimposed thereon. The angles represent the angle of the drum 12 for each ray R. For example, the following table indicates the angle for each stage.

TABLE

| STAGE | ANGLE (DEGREES) |
|---|---|
| A | 10 |
| B | 20 |
| C | 30 |
| D | 40 |
| E | 50 |
| F | 60 |
| G | 70 |

The following table is a summary of the position, height and brightness associated with the angles:

SUMMARY

| POSITION | HEIGHT | BRIGHTNESS |
|---|---|---|
| 30°-40° | FULL | FULL |
| 40°-50° | HALF | FULL |
| 50°-55° | FULL | HALF |
| 55°-60° | NONE | OFF |

The inventors point out that the angles repeat every 60 degrees, since the drum 12 is a regular hexagon, having six sides. Although the figures illustrate the drum 12 as being hexagonal, it should be understood that the drum 12 could be any polygonal shape, such as a hexagon, octagon or other polygonal shape. That is, the angle of stage G is 70 degrees, which is, because of the repetition, the same as 10 degrees for present purposes. From another point of view, the angles can be computed on a Modulo 60 basis, meaning that, for example an angle of 40 degrees, is the same as an angle of 60+40 degrees, which is the same as an angle of 60+60+40 degrees and so on. By analogy, an ordinary clock is a Modulo 12 device. The two o'clock position is the same as the fourteen o'clock position, commonly called fourteen hundred.

In FIG. 13, the wall 34 indicates the illumination patterns projected as the drum 12 rotates. For example, for the span between 30 and 40 degrees in image i2, the hatched region 46 indicates that light of full brightness is projected ahead of the vehicle.

For the span between 40 and 50 degrees in image i2, hatched region 48 indicates that the beam is at full brightness, but directed downward and illuminating the ground forward of the vehicle. This is a low beam mode intended so as not to dazzle either an oncoming driver or a driver in a vehicle in front. How the beam is projected downward will be explained later.

For the span between 50 and 55 degrees in image i2, lightly hatched region 50 indicates that the illumination is projected at half intensity because power has been reduced to the light source 24 in FIG. 1.

For the span between 55 and 60 degrees in image i2 in FIG. 13, region 52 contains no illumination because the light source 24 in FIG. 1 is turned off at this time.

The summary table above summarizes the operation for one embodiment just described and represents pseudo-code or a program used by the microprocessor 28 in FIG. 1.

Advantageously, one form of the invention provides a light source which projects a series of sectors of light. FIG. 13 illustrates sectors, such as that spanning between the labels 30 and 40 degrees on the wall 34. The labels 30 and 40 degrees indicate that the sector in question was produced during rotation of the drum 12 between 30 and 40 degrees. However, in principle, a sector can be arbitrarily small, such as being produced by one or a few degrees of rotation. These sectors fan out from the drum 12 in this example, and collectively form a fan or beam of light FIG. 8 illustrates such a beam. The invention modulates the incident light beam I in FIGS. 2-4 to selectively illuminate and de-illuminate various sectors, to thus control what areas are illuminated ahead of the vehicle. FIG. 13 illustrates such selective illumination.

The shaft encoder 26 and the microprocessor 28 in FIG. 1 form the major elements of a control system which controls the light source 24, motor 20 and drum 12 to control which sectors are illuminated.

The projected light can be directed upward and downward in several ways. For example, in FIG. 14, a second light source 24*b* can be used, which is above, or high relative to, the drum 12. The incident light IA will point downward and will be projected in a downward direction as ray RK. Similarly, a third light source 24*c* will project incident rays IB upward, which will be projected as rays RL, traveling upward. In this example, three light sources 24, 24*b* and 24*c* are present and they are selectively actuated by the microprocessor 28 as required.

The downwardly directed light beam pattern 35 is produced by downward rays RC, RD, RE and RF by light source 24*b* in FIG. 14A is shown.

In FIG. 15, another embodiment wherein the drum 12 shows at least one or a plurality of surfaces or facets 14 having a face F1 that can be slanted off-vertical, thereby causing the surface normal SN to drop below horizontal. The projected light will be directed downward. Similarly, a face F2 can face upward and will cause transmitted rays to project upward.

Other modifications to the surfaces or facets 14 can be implemented. For example, they can be concave, as is face F3 in FIG. 16, which will focus reflected light to a focal point, or can be convex, as is face F4, which will diverge reflected light.

In FIG. 17, a centrifugal blower or fan 54 is attached to the drum 12 to generate cooling air for the light source 24, shown in FIG. 18. In one form of the invention, a central passage CP in the drum 12 connects to an inlet 54*a* of the blower 54. The blower 54 draws air through the central passage CP and then through a duct D which draws cooling air past the light source 24, as indicated by the arrows.

Referring now to FIGS. 19-32, another embodiment will be shown and described. In this embodiment, a transparent drum 12 and principles of refraction are used. A simplified example is provided relative to FIGS. 19 and 20 to illustrate some principles of operation. A triangular block of glass G in FIG. 19 assumes five rotational positions. The incident ray I is refracted, thereby causing the transmitted ray T to sweep leftward as shown in FIG. 19. In FIG. 20, a square block of glass G assumes five rotational positions. The effect of the transmitted ray T shows that the transmitted ray T sweeps from left to right.

FIG. 21 shows a lens L which rotates. The lens L has two focal points F1 and F2 and an axis AX as illustrated. Under the rules of ray-tracing, a ray which passes through a focus will be transmitted parallel to the axis. As the rotation progresses from ten degrees through 30 degrees, the transmitted ray T sweeps upward.

These facts are embodied by a transmissive device 100 (FIG. 22) of another embodiment which will perform the ray-sweeping function of the drum 12 of the embodiment of FIG. 1. FIG. 22 shows a ring of twelve transparent elements 74, supported by a rotatable turntable 76. These elements 74 can take the form of the lens L in FIG. 21 or the blocks of glass in FIGS. 19 and 20, or some combination of those. These twelve elements 74 can conceptually be collected into a single or integral annular transparent body 78 in FIG. 23, having twelve external facets 77, twelve internal facets 79 and a central aperture 80. The central aperture 80 can be eliminated as in FIG. 24. An incident light ray I is transmitted as ray T. The central aperture 80 may be retained, as for cooling purposes described relative to the embodiment of FIG. 18, the light ray R in FIG. 25 need not be transmitted across a diameter, but along a chord as shown.

FIG. 26, left side, illustrates the light projected as in FIGS. 8 and 9. In one form of the invention, the illuminated region 36 is illustrated as being projected on the wall 34 for ease of understanding. The illuminated region 36 ahead of the vehicle is divided into eight zones, shown on each of walls 34B through 34H, which illustrate a plurality of beam patterns that can be produced. The invention allows the driver or a predetermined program stored in the vehicle to select which type of light distribution pattern is desired. For example, in wall 34A, the entire wall is nearly illuminated, which demonstrates a high beam mode. In wall 34B, zone 36E is illuminated by a beam which is directed downward and only illuminates the lower part of the wall 34 in zone 36E illustrating one low beam mode.

The beam pattern 34C, the leftmost two zones 36A are not illuminated at all illustrating another low beam mode. This may be done if the vehicle passes an oncoming vehicle. In beam pattern 34D, the centermost zones 36C are not illuminated at all, or are illuminated with a dimmer light or even a dipped beam of the type mentioned earlier. This can be done when following a vehicle.

In beam pattern 34E, the left and right zones 36B are illuminated with light of higher brightness. This can be done on deserted roads in the countryside. Beam pattern 34F is like beam pattern 34E, with the addition that the central zones 36D are illuminated at a lowered intensity.

In beam pattern 34G, the central zones 36D are not illuminated at all. In beam pattern 34H, the rightmost zones 36B are illuminated with greater intensity to illuminate the side of the road.

This selective illumination can be achieved using the switching system of FIG. 27. Three resistors R1, R2, and R3 connect three signal lines L1, L2, and L3 to ground. The rotary switch SW (FIG. 10) carries eight groups of three contacts each, the groups being labeled 56 through 70. Some of the contacts are connected to a five-volt distribution bus, labeled 5V.

The switch SW is rotatable as indicated by arrow A5, and is biased by a detent 72, so that one of the eight groups 56-70 is always urged into contact with the lines L1-L3 and positions mid-way between groups are avoided.

When group 58, for example, is in contact with lines L1-L3, line L1 is held at 5 volts, while the other two lines are held at zero volts by resistors R2 and R3. The microprocessor receives the signal 0, 0, 5 volts on the three lines or, equivalently, the binary number 001. The table at the left side of switch SW summarizes the signals produced by the rotary switch SW. Eight possible binary numbers are available, running from 000 volts to 555 volts, which represent binary numbers running from 000 (i.e., decimal zero) through 111 (i.e., decimal 7).

This rotary switch SW allows the driver or a predetermined program in the vehicle to select among eight possible light distribution patterns, such as the eight patterns shown in FIG. 26. Significantly, in one form of the invention, these patterns are predetermined and not alterable by the driver, except as to which pattern to select. That is, the driver can select one of eight predetermined patterns, but cannot change any of the patterns themselves.

Additional Illustrative Embodiments

It should be understood that the operation of the drum 12 in FIG. 3 is based on reflection. The reflected ray R sweeps away from the surface normal SN as the drum 12 rotates from stage A through stage F as described. In another embodiment, a transmissive device can be used. Some background principles will first be discussed.

FIGS. 28, 29 and 30 illustrate another transparent body 82 in accordance with another embodiment. This transparent body 82 is analogous to the transparent body 78 in FIGS. 23-25. In FIG. 28, encoder marks 84, analogous to the timing marks 26*a* in FIG. 1, are present on the body 82. The transparent body 82 can be molded of, for example, poly methyl methacrylate (PMMA). Timing marks 84 can be molded into a top surface 82*a* of the body 82. For example, the top surface 82*a* of the body 82 in FIG. 30 can be perfectly smooth and shiny, but the encoder marks 84 in FIG. 28 can each be a frosted square having a rough surface. Under this approach, the encoder marks 84 are constructed in the same step as is the body 82, and no additional elements are required to generate the encoder marks 84.

A rotatable turntable 86, analogous to turntable 16 in FIG. 1, is also shown in FIGS. 28 and 30. The embodiment utilizes the motor 20, shaft encoder 26 and microprocessor 28 described earlier herein.

In FIG. 28, multiple light sources 88 are present, each with its own collimating optics 90. As with the prior embodiments, the light sources 88 may comprise an LED, laser LED, solid-state laser or the like. The light sources 88 are simultaneously or selectively actuated as required and each transmits its rays through the rotating body 82 while one of the facets F as in FIG. 23 sweeps past at least one of the light sources 88 in FIG. 28.

In FIG. 29, another embodiment is shown where the facets F may be formed into the shape of lenses L.

In FIG. 30, another embodiment is shown where the facets F may be slanted upward or downward as illustrated by the facets FA and FB. Those two facets FA, FB can be used in the embodiment shown at the bottom right of FIG. 30, wherein two bodies 82' and 82" are stacked together. An incoming light ray RJ is bent upward, causing it to exit body 82" and enter body 82' from which it exits as transmitted ray RT. The bodies 82' and 82" could be an integral or monolithic construction.

The facets FA, FB may also be slanted downward, as will occur if body 82 is flipped upside-down, so that the top face 82*a* now points downward.

In some embodiments, the cross section of the reflector PAR is elliptical, as indicated. An elliptical reflector has the property that light originating at one focus will be directed to the other focus. The reflectors PAR in FIG. 30 can take the form of these types of paraboloid.

FIG. 31 illustrates another embodiment showing one single light source 88 and a rotating body 82 having lenses L1-L7 on its circumference or periphery. The microprocessor 28 in FIG. 1 controls the timing of illumination of the light source 88. The light source 88 can transmit a pencil beam or a flat beam, as by using the parabolic reflector PAR in FIG. 7.

FIG. 32 illustrates multiple light sources 88. Each lens L1-L7 may be the same or different and paired with another lens located directly across the diameter, so that an entering ray will enter one of the pairs (now located adjacent a light source 88) and be transmitted through the other member of the pair located across a diameter.

In another form of the invention, each lens L1-L7 is paired with a generally opposing flat facet across the diameter, as shown in FIG. 32. The flat facet can act as the entry face for light from the light source 88 and the lens will transmit light to the destination.

The table below is a schedule which indicates how the light sources 88 from FIG. 32 are illuminated for six different headlight beams. It should be understood that the microprocessor 28 in FIG. 1 controls the light sources 88.

| CONDITION | LENS/PATHS USED | POWER OF LIGHT SOURCE |
|---|---|---|
| NORMAL LOW BEAM | L1, L2, L3 | 700 mA |
| LOW SPEED LOW BEAM | L1, L2 | 1,000 mA |
| HIGH SPEED LOW BEAM | L1, L3 | 1,000 mA |
| NORMAL HIGH BEAM | FULL ON | 700 mA |
| LOW SPEED HIGH BEAM | L1, L2, L3, L4 | 1,000 mA |
| HIGH SPEED HIGH BEAM | L1, L2, L4, L5 | 1,000 mA |

Additional Considerations

1. It should be understood that for each embodiment, optics, waveguides, lens and the like may be used to provide an overall beam having a desired pattern.

2. In FIG. 3, the drum 12 rotates counter-clockwise, as indicated in stage A. Facet F performs a sweep past the incident ray I. Incident ray I can be viewed as providing a reference point. The reflected ray RB, for example, can be said to occur at the beginning of the sweep. Ideally, it occurs just as the vertex-point V1 reaches the incident ray I. Similarly, the reflected ray RF occurs at the end of the sweep. Ideally, it occurs just as the succeeding vertex point V2 reaches the incident ray I.

However, assume that the control system only projects rays RC, RD, and RE in FIG. 4. In that case, the reflected rays occurring between ray RB and RC, including RB, in FIG. 3 will be suppressed. That is, reflected rays which would otherwise occur at the beginning of the sweep of facet F will be suppressed.

Similarly, the reflected rays occurring between RE and stage F, including ray RF, will be suppressed. That is, reflected rays which would otherwise occur at the end of the sweep of facet F will be suppressed.

One way to perform this suppression is to terminate power to the light source 24, which will terminate the incident ray I, as indicated by the three X's in FIG. 3A.

3. The light source 24 may include multiple LEDs, which can be the same color or different colors.

In one form of one embodiment of the invention, the drum 12 in FIG. 1 rotates at approximately 1200 rpm, which equates to 20 revolutions per second (i.e., 1200/60). At this speed and because the drum 12 contains six sides, 120 sides per second will transmit reflections, which is equivalent to a frame rate of 120 Hz. If each side is divided into sixty-degree segments, then 120×60, or 7200, such segments will pass per second. (Equivalently, 360 degrees/rev×20 rev/sec=7200 degrees/sec.) The drum 12 traverses 7200 degrees per second.

There are one million microseconds in one second. 1,000,000/7200=140 microseconds per degree. Therefore, 140 microseconds are available to generate an image in each one-degree sector. This permits conventional LEDs to be used. However, the facets 14 rotational speed and the like may be adapted or changed to enable the use of faster (e.g., laser) or slower diodes.

4. In one form of the invention, the light beam or sheet of light in FIG. 8, which acts as the incident beam I in FIGS. 3 and 8, can be formed by a stack or column of the light sources 24 in FIG. 31, together with their respective collimators (not shown) if desired. The microprocessor 28 in FIG. 1 switches the light sources 24 on and off at the proper times, to generate a desired image or beam in the transmitted rays such as RC in FIG. 8. For example, if the stack contains five light sources 24, at one instant the five lights may be ON OFF OFF ON ON, running top to bottom. At the next instant they may be OFF OFF ON ON OFF, and so on.

This arrangement allows the projected light beam to be comprised of individual components or even pixels. In this example of five light sources 24, the light beam contains five pixels in the vertical direction. The number in the horizontal direction depends on how long each light source 24 is kept illuminated. In one example given above, the illumination persists for one degree of rotation of the drum 12 in FIG. 1. Simple geometry, based on the desired location of the wall 34 in FIG. 8 will provide the horizontal dimension of the one-degree pixels in this example.

5. Advantageously, the embodiments described herein comprise a simplified dynamic beam module that contain only 3 simple components. The first is a LED/PCB & passive heat sink electronic device with individually controlled LED's or lasers. The second is a primary optial lens or reflector columnator that gathers the light to be sent to provide vertical cutoffs and a narrow intense beam. The thrid component is a multiple beam shaping optical rod that would allow multiple beam patterns of light to be sent out and controlled to be (100's hz to xxMhz) of light switching by the driver.

6. Another advantage of the embodiments described herein is lower cost and ease of manufacturing the electronic, optics, and assembly. The cost could be 50% of the cost of a more complex device.

7. Advantageously, the embodiments also provide:

The ability to turn the LEDs off and on for different optics and during rotation of the drum 12.

The spinning optic allows the production of multiple predetermined patterns.

The ability to digitally change the predetermined pattern to adapt to vehicle conditions by turning LEDs on and off and the ability to generate multiple patterns by the spinning optics.

The optical encoder is molded into the optic rod to provide precise control of the on/off light source.

The spinning optical device makes multiple beam patterns and includes a cooling fan.

The ability to modulate the current and on/off time to form custom beam patterns.

8. In one form of the invention, the FAN or sheet of light in FIG. 8, which acts as the incident beam I in FIGS. 3 and 8, can be formed by a stack or column of the light sources 24 together with their collimators if desired. The microprocessor 28 in FIG. 1 switches the light sources 24 on and off at the proper times, to generate a desired image in the transmitted rays such as RC in FIG. 8.

For example, if the stack contains five light sources 24, at one instant the five light sources 24 may be ON OFF OFF ON ON, running top to bottom. At the next instant they may be OFF OFF ON ON OFF, and so on.

This arrangement allows the projected light beam to be comprised of individual pixels. In this example of five light sources 24, the light bean contain five pixels in the vertical direction. The number in the horizontal direction depends on how long each light source is kept illuminated. In one example given above, the illumination persists for one degree of rotation of the drum 12 in FIG. 1. Simple geometry, based on the location of the wall 34 in FIG. 8, will provide the horizontal dimension of the one-degree pixels in this example.

9. While the embodiments have been shown and described as having a use as a headlight for a vehicle, the lighting and/or signaling device could 10 could also be placed in a rear lamp, fog lamp, daytime running lamp, marker lamp, interior lighting lamp or the like.

This invention, including all embodiments shown and described herein, could be used alone or together and/or in combination with one or more of the features covered by one or more of the claims set forth herein, including but not limited to one or more of the features or steps mentioned in the bullet list in the Summary of the Invention and the Claims.

While the system, apparatus and method herein described constitute preferred embodiments of this invention, it is to be understood that the invention is not limited to this precise system, apparatus and method, and that changes may be made therein without departing from the scope of the invention which is defined in the appended claims.

What is claimed is:

1. A steerable lighting and/or optical device for a vehicle, comprising:

at least one light source which produces a fan of light definable into sectors;

a control system configured to determine light intensity for each sector and to energize at least one determined pattern of light projected ahead of the vehicle; and a rotating drum rotatable around an axis and comprising a plurality of reflective facets on a periphery of the rotating drum and positioned to receive light from said at least one light source and provide said fan of light in response thereto, wherein a cross-section of the rotation drum across the axis forms a polygon with more than four sides which correspond to the reflective facets.

2. The steerable lighting and/or optical device according to claim 1, wherein said at least one light source can selectively direct sectors upward and downward.

3. The steerable lighting and/or optical device according to claim 1, wherein said rotating drum comprises a plurality of timing marks on a surface thereof.

4. The steerable lighting and/or optical device according to claim 1, wherein at least one of said plurality of reflective facets comprises an angled face.

5. The steerable lighting and/or optical device according to claim 1, wherein said control system comprises a microprocessor to control said at least one light source as said control system simultaneously controls rotation of said rotating drum.

6. The steerable lighting and/or optical device according to claim 1, wherein said rotating drum is generally transparent.

7. The steerable lighting and/or optical device according to claim 1, wherein said at least one light source comprises a light-emitting diode or laser which emits light toward said rotating drum for reflection.

8. The steerable lighting and/or optical device according to claim 1, further comprising sensors to ascertain angular position of said rotating drum and a microprocessor configured to control intensity of said light source based on an angular position.

9. The steerable lighting and/or optical device according to claim 8, wherein said sensors comprise marks on said rotating drum.

10. The steerable lighting and/or optical device according to claim 1, wherein said control system controls intensity from zero to full intensity.

11. The steerable lighting and/or optical device according to claim 1, wherein at least one of the reflective facets is slanted with respect to the axis at an acute angle and at least another of the reflective facets is slanted with respect to the axis at an obtuse angle.

12. A steerable lighting and/or optical device for a vehicle, comprising:

a rotating drum rotatable about an axis and having reflective facets on a periphery of the rotating drum which sweep past a reference point;

at least one light source which projects light toward said reference point, the sweeping facets reflecting the light into a fan of light which is projected from the vehicle;

a control system which senses rotational position of said rotating drum and modulates said at least one light source according to a mode of operation, the mode being selected by a human driver from a group of possible modes of operation, and the selected mode producing a selected pattern or beam of light, wherein a cross-section of the rotation drum across the axis forms a polygon with more than four sides which correspond to the reflective facets.

13. The steerable lighting and/or optical device according to claim 12, wherein said control system suppresses some reflected light which would otherwise occur at the beginning of a sweep of a facet.

14. The steerable lighting and/or optical device according to claim 12, wherein said selected pattern of light is different from at least one other pattern produced by another mode.

15. The steerable lighting and/or optical device according to claim 12, further comprising a cooling fan which rotates with said rotating drum, which cools said at least one light source.

16. The steerable lighting and/or optical device according to claim 12, further comprising a selector switch, operable by a driver of the vehicle, to select a predetermined mode of operation.

17. The steerable lighting and/or optical device according to claim 16, wherein said selector switch allows said driver to select one of a predetermined modes of operation, but said driver is not able to change a mode of operation.

18. The steerable lighting and/or optical device according to claim 12, wherein said steerable lighting and/or optical device produces a beam which, in at least some regions, is uniform in color and continuous in intensity from top to bottom.

19. The steerable lighting and/or optical device according to claim 12, wherein said steerable lighting and/or optical device comprises:

a plurality of light sources; and said control system selectively energizing said plurality of light sources during rotation of said rotating drum to generate a beam comprising a predetermined matrix pattern of beams from said plurality of light sources.

20. The steerable lighting and/or optical device according to claim 12, wherein at least one of the reflective facets is slanted with respect to the axis at an acute angle and at least another of the reflective facets is slanted with respect to the axis at an obtuse angle.

* * * * *